US005749513A

United States Patent [19]

Strauser

[11] Patent Number: 5,749,513

[45] Date of Patent: May 12, 1998

[54] CORRUGATED PAPERBOARD BOX WITH REINFORCED SIDE WALLS

[75] Inventor: Buford R. Strauser, Wentzville, Mo.

[73] Assignee: Innovative Enterprises, Inc., Washington, Mo.

[21] Appl. No.: 702,289

[22] Filed: Aug. 23, 1996

[51] Int. Cl.[6] ..... B65D 5/50

[52] U.S. Cl. ..... 229/199; 206/280; 206/282; 229/23 R; 229/117.05; 229/193; 229/919

[58] Field of Search ..... 229/23 R, 117.05, 229/193, 194, 198.2, 199, 919; 206/279, 280, 288, 289, 299, 427

[56] References Cited

U.S. PATENT DOCUMENTS

| | | | |
|---|---|---|---|
| 2,331,582 | 10/1943 | Trost | 229/117.05 |
| 2,568,204 | 9/1951 | Reeser . | |
| 2,903,176 | 9/1959 | Crane . | |
| 3,148,769 | 9/1964 | Bryant | 229/193 |
| 3,493,101 | 2/1970 | Collin | 206/280 |
| 3,764,059 | 10/1973 | Knowles | 229/194 |
| 4,020,988 | 5/1977 | Kipp | 229/193 |
| 4,129,248 | 12/1978 | Casutt | 229/117.05 |
| 4,426,015 | 1/1984 | Preston et al. | 229/199 |
| 4,519,538 | 5/1985 | Omichi | 206/427 |
| 4,576,280 | 3/1986 | Dove et al. | 206/282 |
| 4,676,429 | 6/1987 | Crowe et al. | 229/193 |
| 5,312,035 | 5/1994 | Nold et al. | 229/193 |

FOREIGN PATENT DOCUMENTS

| | | | |
|---|---|---|---|
| 2191172 | 12/1987 | United Kingdom | 220/441 |

*Primary Examiner*—Gary E. Elkins
*Attorney, Agent, or Firm*—Polster, Lieder, Woodruff & Lucchesi, L.C.

[57] ABSTRACT

A box has front and back walls and a bottom wall extended between the lower margins of those walls. It also has side walls that are attached to the front and back walls and close the sides of the box. Each side wall contains two panels which are joined together at a manufacturer's joint midway between the front and back walls to create a column within the side wall. The column extends all the way to the bottom wall and enhances the strength of the side wall. In one embodiment the columns in the side walls support a beam that extends through the box and items may be suspended from the beam. In another embodiment, the bottom wall folds, as do the side walls at their columns, so that the box may be supplied in a knocked-down condition.

14 Claims, 8 Drawing Sheets

CORRUGATED PAPERBOARD BOX WITH REINFORCED SIDE WALLS

BACKGROUND OF THE INVENTION

This invention relates in general to paperboard boxes, and more particularly to corrugated paperboard boxes that have the capacity to transfer substantial loads through their walls.

Boxes formed from corrugated paperboard serve as packaging for a wide variety of merchandise and other items. The typical box has upright walls formed from a single thickness of corrugated paperboard and ends—actually, the top and bottom—formed from overlapping flaps. The box derives from a corrugated paperboard blank containing panels corresponding to the upright walls and to the flaps. Scores separate the wall panels from each other and from the flap panels, enabling the walls and flaps to fold easily. Actually, the blank is folded over upon itself along the scores which join its wall panels, and the endmost panels are joined together by glue to create a manufacturer's joint. In the box, this joint exists along one of the upright corners, perhaps giving the box somewhat more strength at that corner than at the remaining upright corners, which are otherwise the strongest regions of box from the standpoint of transferring vertical loads. But still, the box does not have much capacity to transfer vertical loads such as those which might be derived from stacking one box upon another or those which might be produced from a suspended load within the box.

Apart from that the typical box requires gluing or stapling equipment to transform it from a collapsed condition to a useful erected container, and this occurs usually where the box is loaded. But some boxes must be erected at locations where gluing or stapling equipment is unavailable or impractical to use.

The present invention resides in a corrugated paperboard box which has, within its side walls, columns that enhance the strength of those side walls and as such enable the box to transmit greater vertical loads. Those loads may result from the box lying beneath other boxes in a stack of boxes, or simply from items being suspended from the upper regions of the side walls in the box. The invention also resides in a box that is erected from a folded blank without any separate fastening devices or specialized equipment, and in a box that folds within its own periphery to occupy minimal space.

The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
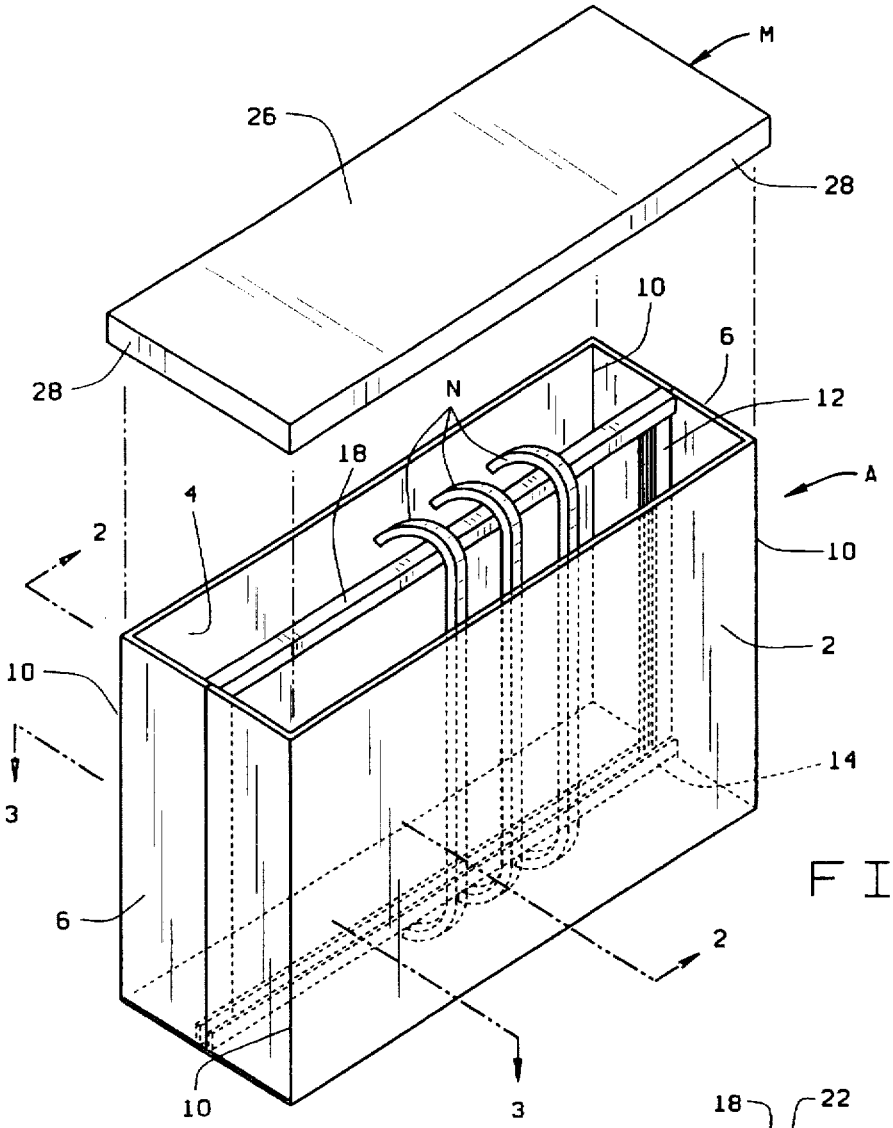
FIG. 1 is a perspective view of a corrugated paperboard box constructed in accordance with and embodying the present invention, and further showing packaged items suspended in the box and a lid removed from the box.

Referring now to the drawings, a box A (FIG. 1) has the capacity to support one or several items N in suspended condition, that is with the items suspended from its upper regions and depending into the lower regions of its interior. Despite the weight of the items N, the box A retains its shape and indeed transfers the weight of the items N through the vertical walls of the box A. Moreover, the box A is configured to position the suspended items N and further stabilize them so they do not swing or move about within the confines of the box.

The box A includes (FIGS. 1 & 2) front and back walls 2 and 4, side walls 6, and a bottom wall 8, all joined together at right angle corners 10. The front and back walls 2 and 4 and the side walls 6 surround the hollow interior of the box A, and that hollow interior is exposed through an open top, the walls 2, 4 and 6 being free of any flaps along their upper margins. Each side wall 6 is reinforced by a column 12 which extends from the very bottom of the wall 6 upwardly midway between the two corners 10 at which the wall 6 is attached to the front and back walls 2 and 4. The column 12 projects into the interior of the box A and terminates slightly below the upper margin of the wall 6. The bottom wall 8, on the other hand, has a stabilizing rib 14 which extends between the two side walls 6 midway between the front and back walls 2 and 4 and projects upwardly into the interior of the box A. The rib 14 generally aligns with the columns 12, but in the region of the side walls 6, the ends of the rib 14 lie to the sides of the two columns 12, since the columns 12 extend all the way to the bottom wall 8. The rib 14 remains upright.

At the upper end of the box N a beam 18 (FIG. 1) extends through the hollow interior midway between the front and back walls 2 and 4. The beam 18 at its ends is connected to and indeed supported on the columns 12, and thus any weight suspended from the beam 18 is transferred through the columns 12 to the bottom wall 8 which will normally rest on a solid supporting surface such as a floor or the deck of a pallet.

The beam 18 is formed from layers of plain paperboard, which are joined together with glue in a U-shaped configuration. As such the beam 18 has (FIG. 2) a pair of legs 20, which lie parallel to each other, and a short connecting portion 22 joining the two legs 20. The distance between the two legs 20 essentially equals the thickness of the columns 12, and the beam 18 at its ends fits over the upper ends of the columns 12 with the two legs 20 lying along the sides of the columns 12 and the connecting portion 22 resting on top surfaces of the columns 12. The beam 18 is attached to the columns 12 with glue or with staples driven through its legs 20 and into the columns 12. The upper ends of the columns 12 lie below the upper margins of the side walls 6 and the front and back walls 2 and 4 as well by a distance at least as great as the thickness of the connecting portion 22 in the beam 18 so that the beam 18 remains fully within the interior of the box A. Being affixed to the columns 12, the beam 18 maintains a fixed spacing between the two side walls 6, by preventing them from spreading at their upper ends. In other words, the beam 18 stabilizes the side walls 6. Each paperboard layer in the beam 18 extends longitudinally the full length of the beam 18 and laterally through its two legs 20 and the connecting portion 22 without interruption.

Figure 2:
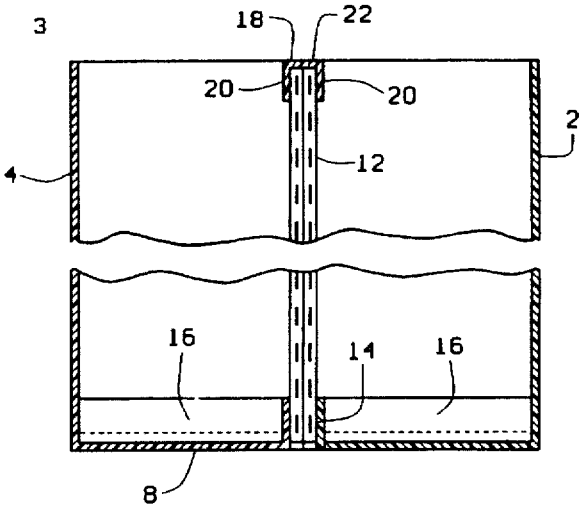
FIG. 2 is a sectional view of the box taken along line 2—2 of FIG. 1.
Figure 3:
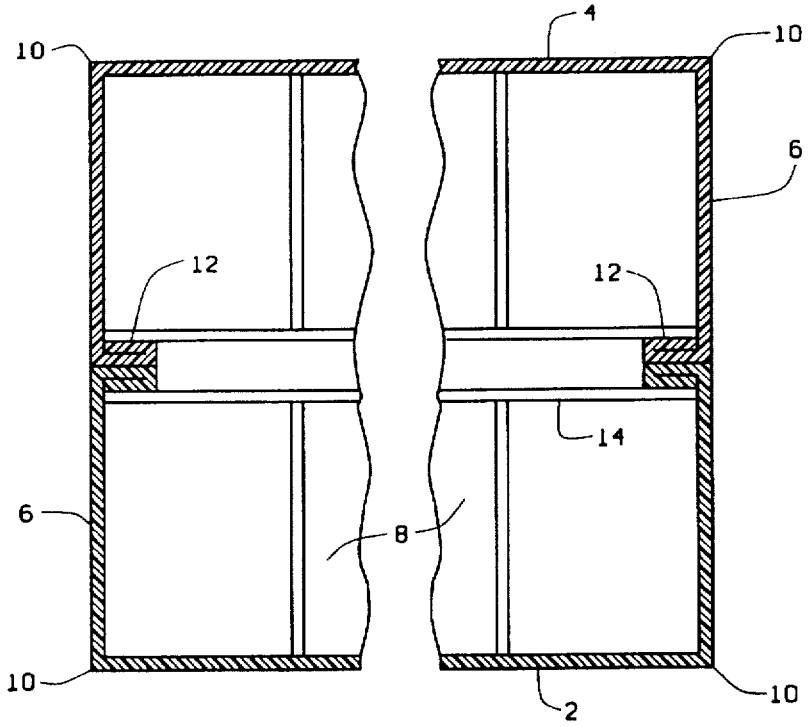
FIG. 3 is a sectional view of the box taken along line 3—3 of FIG. 1.

The items N are suspended from the beam 18 and usually hook over the beam 18 (FIG. 1). If the items N extend downwardly close to the bottom wall 8, the rib 14 may serve to stabilize them. For example, the lower end of the items N may lie along and contact the rib 14 so that the rib 14 prevents the items N from rocking back and forth on the beam 18. The beam 18 serves as an excellent support for clothes hangers, thus rendering the box A well-suited for shipping clothing. Another beam 18 may be installed in the interior of the box A simply by creating slits in the ribs 14 at the elevation desired for that beam 18. The slits should equal the thickness of the connecting portion 22 of the beam 18 since they receive the connecting portion 22 at its ends.

Typically, the open upper end of the box A is closed with a cover M (FIG. 1) that includes a main panel 26 which extends across the open top and lips 28 which project downwardly from the panel 26 and lie along the exterior surfaces of the walls 2, 4 and 6 in the upper regions of those walls. The cover M, which is likewise formed from corrugated paperboard, is conventional in construction. It too is erected without glue or staples.

Figure 4:
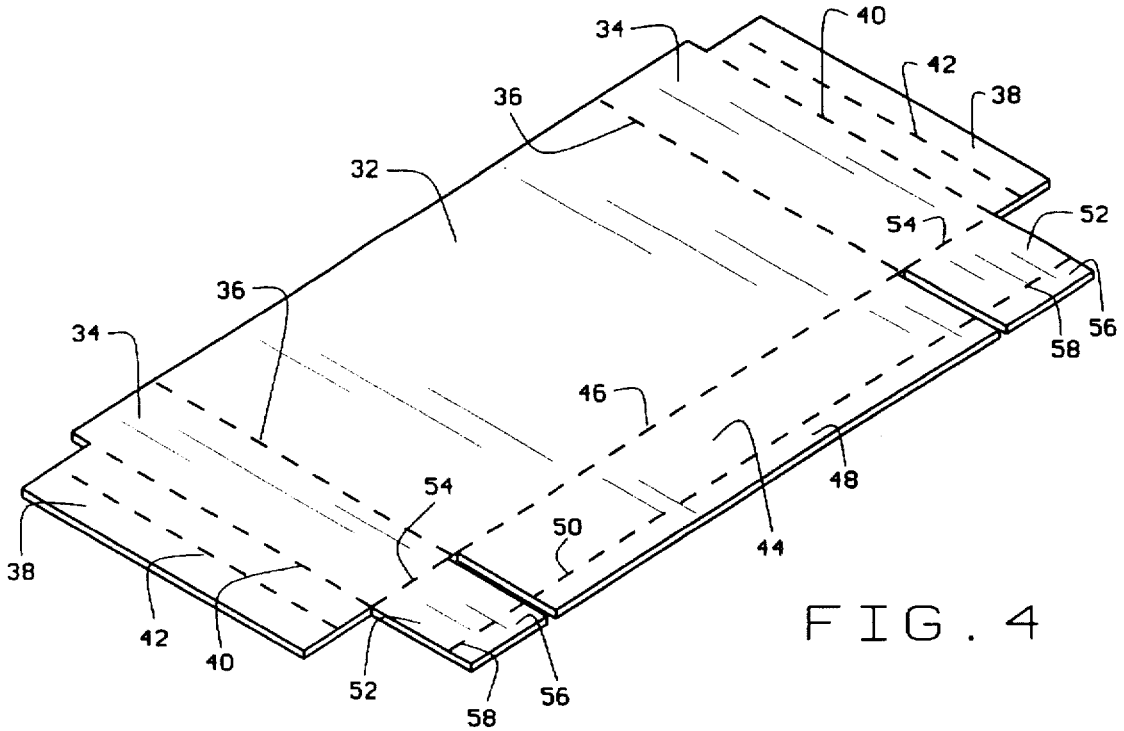
FIG. 4 is a perspective view of one of two identical blanks from which the box of FIG. 1 is formed.

The box A is formed from two identical blanks 30, which are made of corrugated paperboard. Each blank 30 has (FIG. 4) a main panel 32 and smaller side panels 34 connected to it along scores 36 at which the side panels 34 may fold relative to the main panels 32. The side panels 34 in turn have extensions 38 connected to them along more scores 40, and each extension is divided into two segments by another score 42. The three scores 36, 40 and 42 lie parallel to each other. The main panel 32 and the two side panels 34 share a common free margin at which the scores 36 and 40 terminate, but the extension 38 terminates short of that margin, thus producing a notch in the blank 30 at the end of each extension 38.

In addition, each blank 30 has a bottom panel 44 which is connected to the main panel 32 along a score 46 that lies parallel to the free margin of the panel 32. The bottom panel 44 also has an extension 48 connected to it along a score 50, but in contrast to the extensions 38, the extension 48 is not further divided. The width of the bottom panel 44 exceeds that of extension 48 considerably, and is slightly less than the side panels 34.

Finally, each blank 30 has end panels 52 which are attached to its side panels 34 along scores 54 which align with the score 46 and also with the bottom margins of the extensions 38. The end panels 52, which are about as wide as the side panels 34 from which they project, also have extensions 56 connected to them along scores 58.

The corrugations in the blank 30 lie parallel to scores 36 that separate the main panels 32 and side panels 34.

Figure 5:
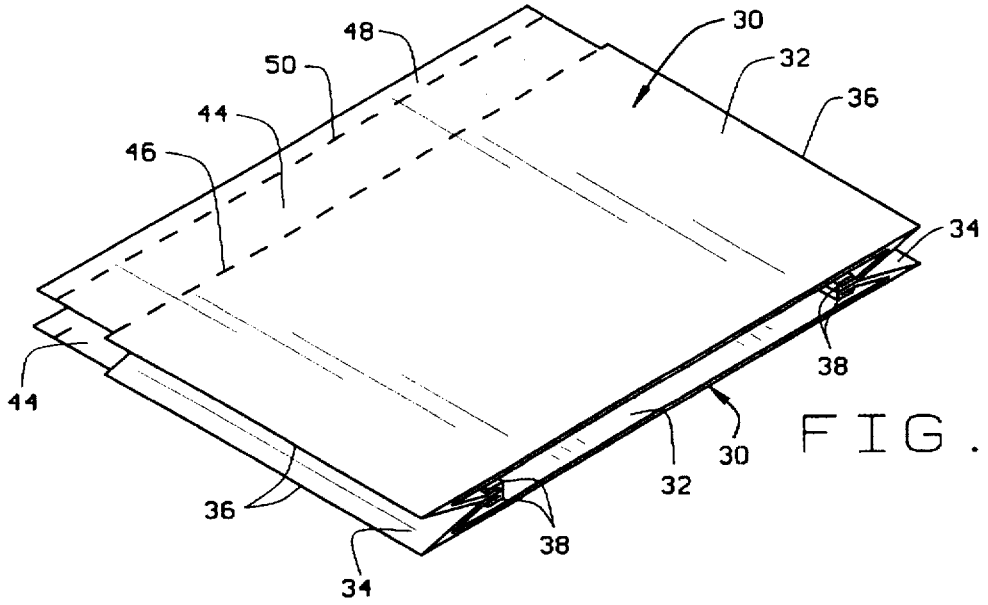
FIG. 5 is a perspective view of two of the blanks of FIG. 4 joined together in a flattened condition.

Each box A contains two blanks 30 which, when the box A is in a knocked down or collapsed condition, lie face-to-face and are joined together at their extensions 38 (FIG. 5). Actually, each extension 38 is folded over onto itself along its score 42, and the two portions of the extension 38 are joined together preferably with glue. The side panels 34 and the folded extensions 38 are then folded over onto the main body panel 32 along the scores 36. The folded extensions 38 of the two blanks 30 are next brought face-to-face and joined, again preferably with glue to create manufacturer's joints at the sides of the joined-together blanks 30. When folded into its knocked down condition, the box A lies within a perimeter no greater than that occupied when it is erected.

Figure 6:
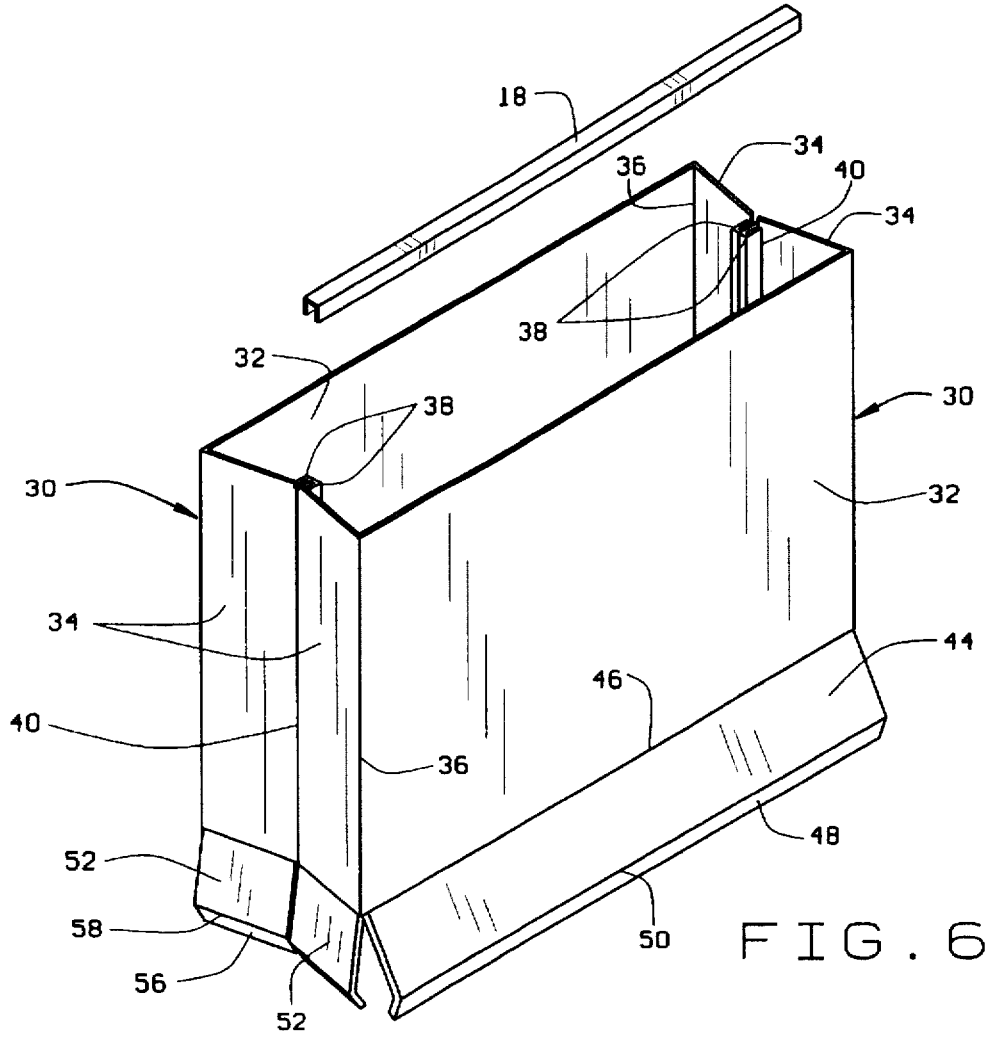
FIG. 6 is a perspective view showing the joined-together blanks of FIG. 5 brought into a tubular configuration as they are converted into the box of FIG. 1.

To erect the box A from the two joined-together blanks 30, the main panels 32 of the two blanks 30 are moved apart, and to accommodate this separation, the side panels 34 fold relative to the main panels 32 at the scores 36 to form the corners 10 (FIG. 6). The folded-over and joined-together extensions 38 fold relative to the side panels 34 along the scores 40 that join the extensions 38 to the side panels 34. This, in effect, creates a tube with the joined-together extensions 38 projecting into the interior of the tube. Next the end panels 52 are folded inwardly along the scores 54 and brought generally upwardly toward the interior surfaces of the side panels 34. With the end panels 52 so disposed, the bottom panels 44 are folded inwardly along the scores 46 and brought beneath the side panels 34. Also the extensions 48 on the bottom panels 44 may be folded upwardly along the scores 50. As the bottom panels 44 for the two blanks 30 approach each other their respective extensions 48 tuck to the sides of the columns 12. Next the elevated end panels 52 are lowered into the bottom panel 44. The bottom panels 44 and end panels 52 are attached to the underlying surface, such as by staples driven through them into the underlying surface. Finally, the beam 18 is installed over the upper ends of the folded extensions 38 on the side panels 34.

The two blanks 30 when so folded and otherwise arranged form the box A (FIG. 1). Within the box A, the aligned side panels 34 of the two folded blanks 30 form the side walls 6, the main panels 32 form the front and back walls 2 and 4, and the aligned bottom panels 44, and also the end panels 52, form the bottom wall 8. The columns 12 in the box A constitute the doubled back extensions 38 which are joined together, thereby providing within each column 12 four layers of corrugated paperboard—layers which impart considerable strength to the columns 12 and to the side walls 6 of which they form a part. The rib 14 in the bottom wall 8 derives from the abutting extensions 48 on the bottom panels 44 of the two blanks 30.

A modified box B (FIG. 7) dispenses with the beam 18, yet retains the capacity to support and transmit considerable weight. The box B has front and back walls 62 and 64, side walls 66, and a bottom wall 68, all of which meet at corners 70. In addition, the box B has columns 72 within its sides walls 66 midway between the corners 70 at which those walls 66 are connected to the front and back walls 62 and 64. The columns 72 reinforce the side walls 66.

Figure 8:
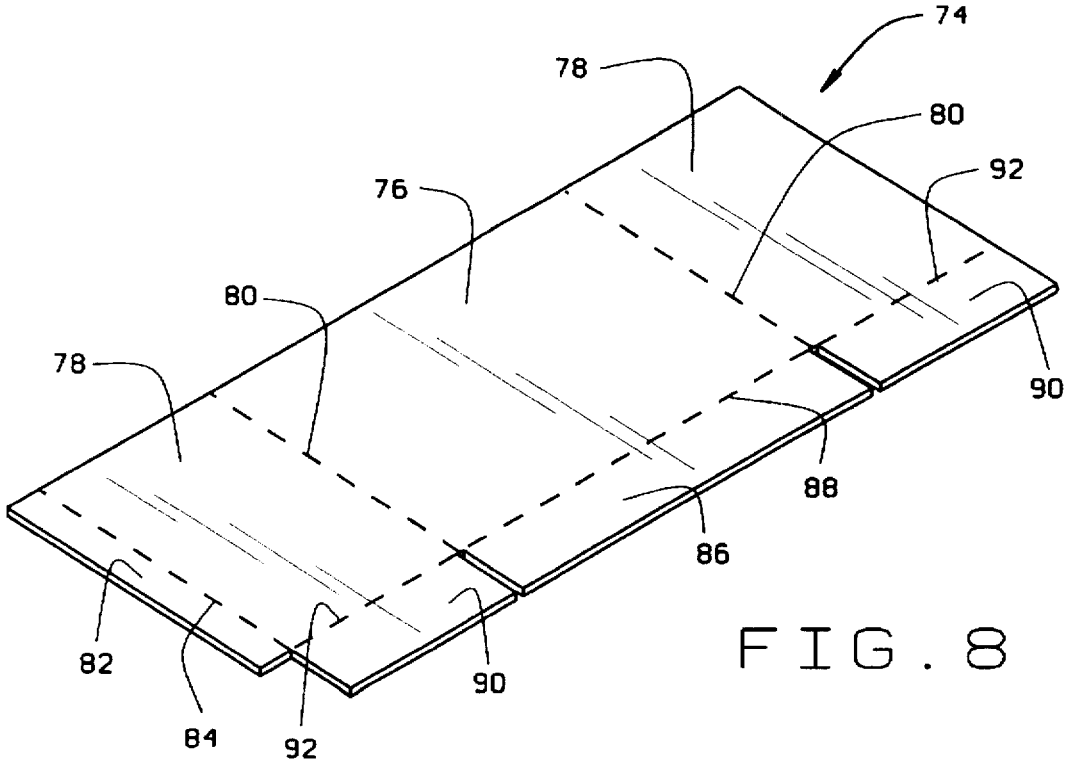
FIG. 8 is a perspective view of one of two identical blanks from which the box of FIG. 7 is formed.

Like the box A, the box B derives from two blanks 74 (FIG. 8) which are folded and then joined together. Each blank 74 includes a main panel 76 and two side panels 78 which are joined to the main panel 76 along scores 80. One of the side panels 78 has an extension 82 projecting from it along another score 84. In addition, the blank 74 has a bottom panel 86 attached to it along still another score 88 and end panels 90 attached to the side panels 78 along yet more scores 92 which align with and form extensions of the score 88. The corrugations lie parallel to the scores 80 and 84.

Figure 9:
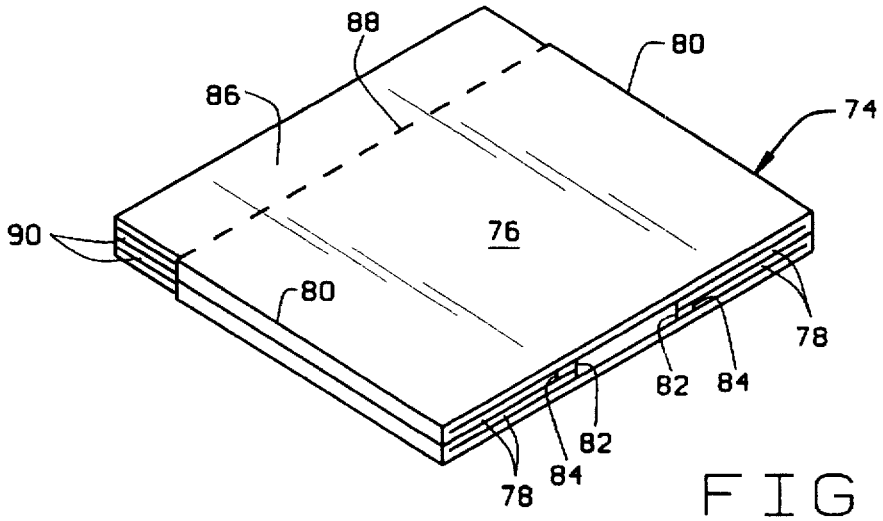
FIG. 9 is a perspective view of two of the blanks of FIG. 8 joined together in a flattened condition.

The box B comes in a knocked down condition with its two blanks 74 joined together only at their extensions 82. More specifically, each side panel 78 is folded along its score 80 onto the main panel 76 from which it projects, and the extension 82 is attached by glue to that side panel 78 of the other blank 74 which does not have an extension 82. In the knocked down condition the two blanks 74 lie face-to-face with the two extensions 82 flat between them at their ends (FIG. 9). Thus, the box B likewise folds into its perimeter.

Figure 10:
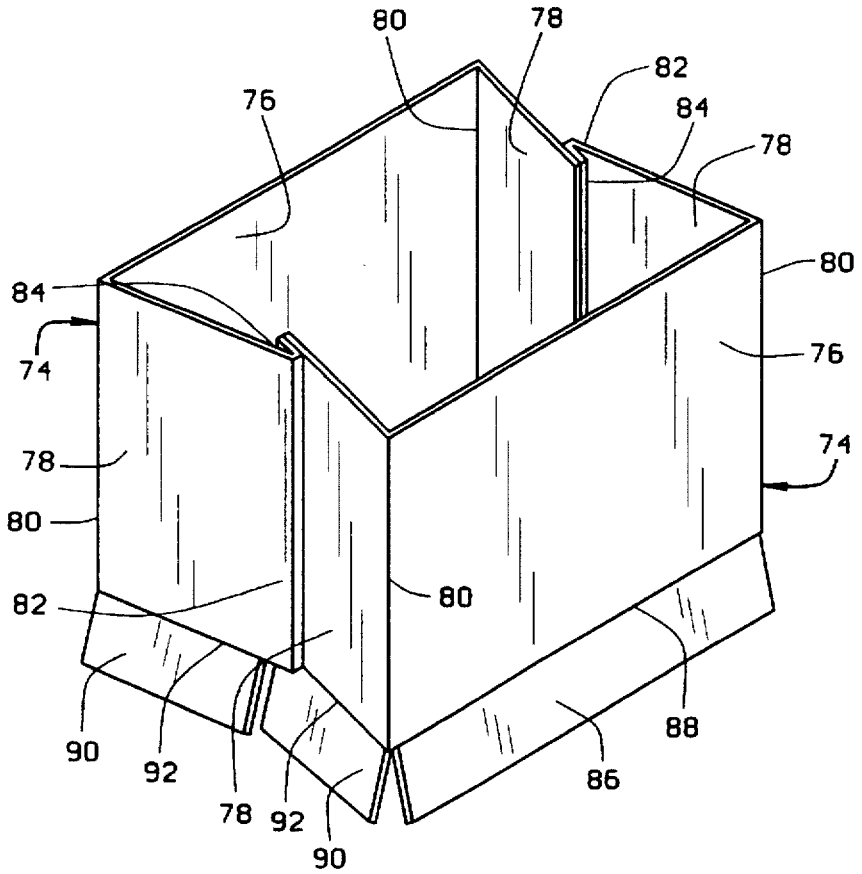
FIG. 10 is a perspective view of the joined-together blanks of FIG. 9 brought into a tubular configuration as they are converted into the box of FIG. 7.

To erect the box B from the joined-together blanks 74, the main panels 76 are moved apart (FIG. 10). The side panels 78 accommodate this separation by folding away from the main panels 76 along the scores 80 and also at the scores 84 for the extensions 82. When the side panels 78 lie generally perpendicular to the main panels 76, the end panels 90 on them are folded inwardly. Then the bottom panels 86 on the main panels 76 are folded inwardly between the end panels 90. The bottom panels 86 and end panels 90 are secured to a supporting surface, such as a pallet deck, with staples driven through them.

Figure 7:
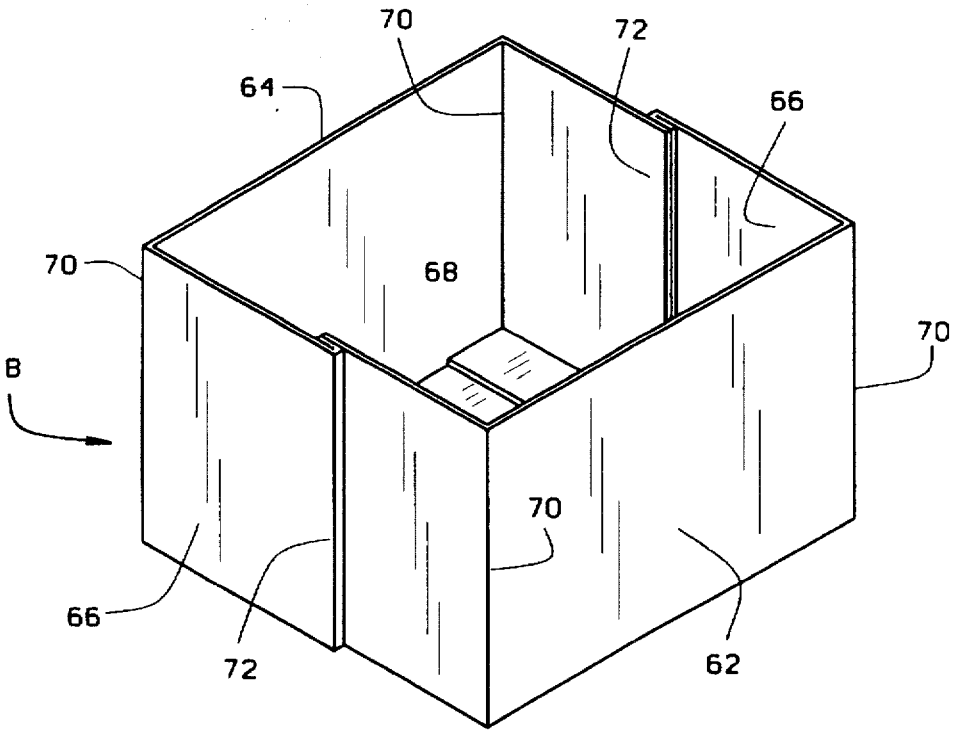
FIG. 7 is a perspective view of a modified box constructed in accordance with and embodying the present invention.

The main panels 76 of the two blanks 74 form the front and back walls 62 and 64 of the Box B; the joined together side panels 78 of the two blanks 74 form the side walls 66; nd the overlapping bottom panels 86 and end panels 90 form the bottom wall 68 (FIG. 7). The manufacturer's joint formed by the extensions 82 joined to the free side panels 78 form the columns 72.

Figure 11:
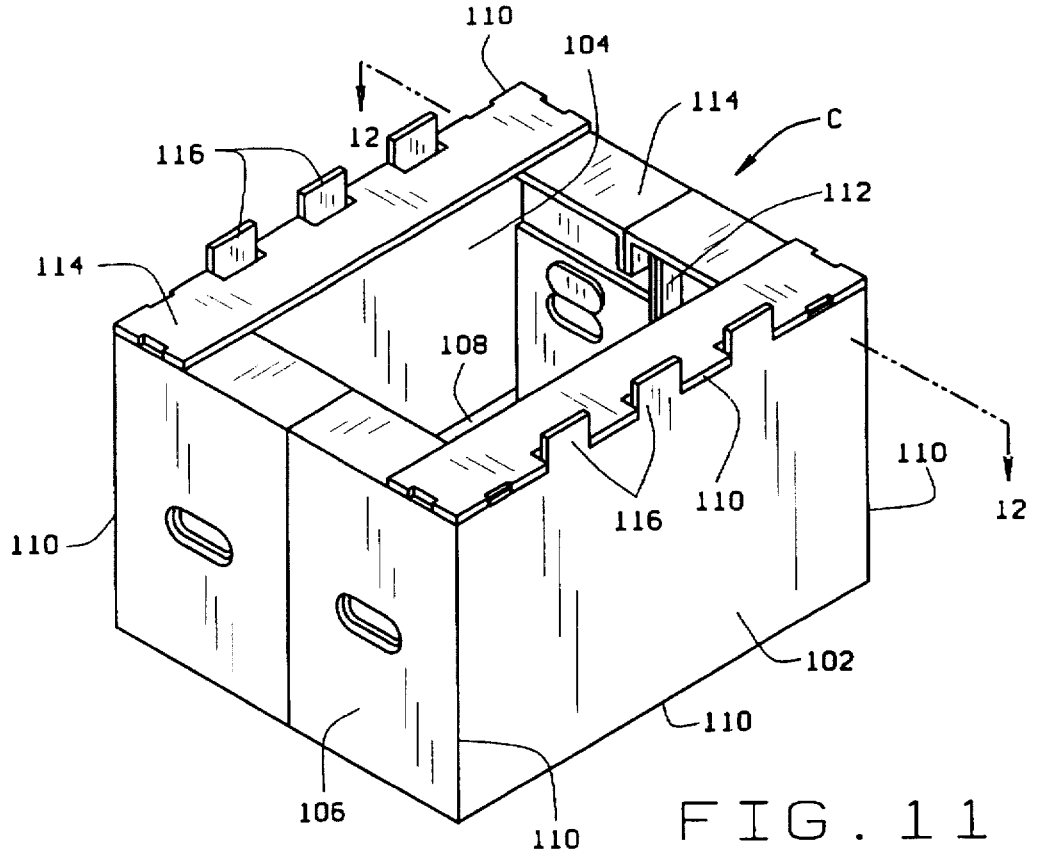
FIG. 11 is a perspective view of still another modified box constructed in accordance with and embodying the present invention.

Still another box C (FIG. 11) differs from the other boxes A and B in that it derives from a single blank and may be shipped in a knocked down condition. Yet the box C is erected without any special equipment, and this makes it particularly adapted for use in the field. Moreover, the box C, like the boxes A and B, is reinforced along its sides and thus suited for supporting and transferring greater weight.

Figure 12:
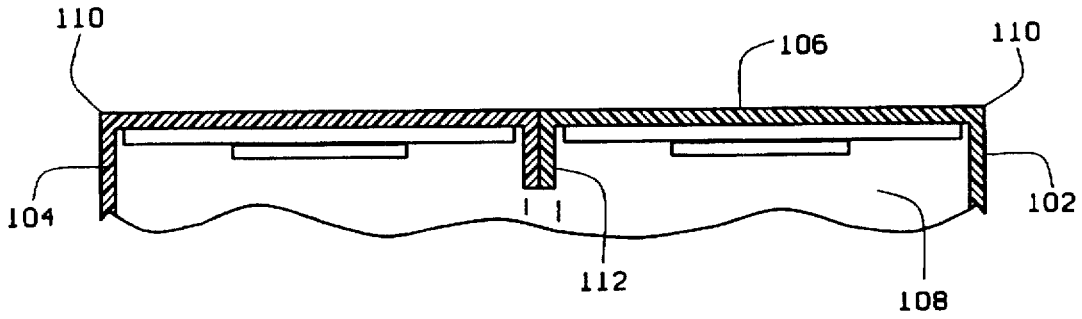
FIG. 12 is a sectional view taken along line 12—12 of FIG. 11.

More specifically, the box C includes (FIGS. 11 & 12) front and back walls 102 and 104, side walls 106 and a bottom wall 108. The front and back walls 102 and 104 and the side walls 106 are joined together at corners 110, and likewise the front and back walls 102 and 104 are joined to the bottom wall 108 at horizontal corners 110. The side walls 106, for the most part, contain two layers of corrugated paperboard and, in addition, columns 112 which are located midway between the vertical corners 110. The columns 112, which take the form of manufacturer's joints, impart considerable strength to the side walls 106. Finally along their upper margins, the front and back walls 102 and 104 and the side walls 106 turn inwardly at more horizontal corners 110 to form a supporting rim 114 around the otherwise open top of the box C. The horizontal corners 110 along the front and back walls 102 and 104 at the rim 114 are not continuous, but instead are interrupted by positioning tabs 116 which project upwardly beyond the rim 114. The rim 114 coupled with the tabs 116 render the box well-suited for stacking, for a like box C will fit between the tabs 116 and rest on the rim 114. The columns 112 transfer much of the weight of the overlying box to the surface on which the box C rests.

Figure 13:
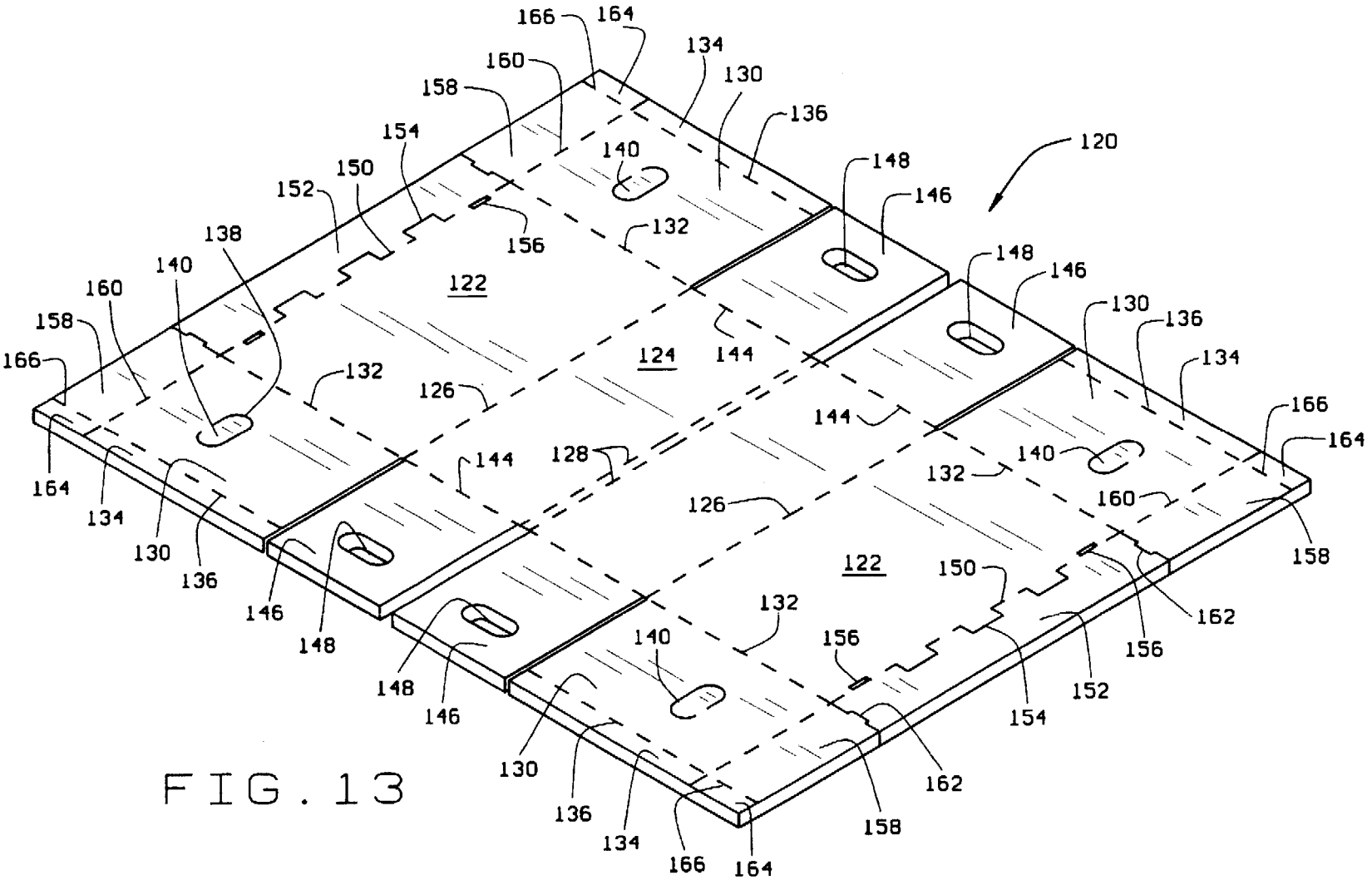
FIG. 13 is a perspective view of a single blank from which the box of FIG. 11 is formed.

The box C derives from a single blank 120 (FIG. 13) which is formed from corrugated paperboard. The blanks 120 include two main panels 122 and a bottom panel 124 interposed between the main panels 122. The panels 122 and 124 are joined together along scores 126 and the bottom panel 124 itself has twin, closely spaced, scores 128 located midway between and parallel to the scores 126.

The main panels 122 are also joined to side panels 130 along additional scores 132 which are perpendicular to the scores 126, there being a score 132 and side panel 130 on each side of each main panel 122. Each side panel 130, in turn, has a short extension 134 connected to it along a score 136 that lies parallel to the score 132 by which the side panel 130 is attached to its main panel 122. The width of each side panel 130, which is the distance between the two scores 132 and 136, is essentially one-half the width of the bottom panel 124, that is to say one half the distance between the scores 126 at which the main panels 122 are joined to the bottom panel 124. Each side panel 130 contains an elongated cutout 138 and a flap 140 which folds out of the cutout 138 along its upper margin, which is actually another, although quite short, score 142.

The bottom panel 124 is essentially circumscribed by scores. Along two of its margins lie the scores 126 at which the main panels 122 are attached to the bottom panel 124. Its remaining margins are defined by additional scores 144 which intersect the scores 126 at right angles, and at the scores 144, liner panels 146 are attached to the bottom panel 124, there being a separate liner panel 146 on each side of the twin scores 128, for a total of four liner panels 146 in all. The liner panels 146 are as wide as the side panels 130, but need not be as long. The liner panels 146 contain elongated cutouts 148 that are slightly larger than the cutouts 138 in the side panels 130 and occupy corresponding positions in the panels 146 as well.

Like the bottom panel 124, the main panels 122 are also bordered on all margins by scores. Of course, there are the scores 126 at which the main panels 122 are connected to the bottom panel 124. Then there are the perpendicular scores 132 at which the side panels 130 are attached. Finally, there are scores 150 at which top flaps 152 are attached. Unlike the scores 126 and 132, the scores 150 are not continuous. Instead, they are interrupted by notches 154 where the main panels 122 project slightly beyond the scores 150. Also, the scores 150 are interrupted by smaller lock slots 156 which lie near the ends of the scores 150 and are essentially confined to the scores 150.

The side panels 130 also have top flaps 158 connected to them at scores 160 which align with the scores 150. At their ends, the side panels 130 are provided with lock tabs 162 which project beyond the scores 132. The offset of the tabs 162 from the scores 160 equals the offset of the small notches 156 in the scores 150 from the side scores 132. At their opposite ends the top flaps 158 have short extensions 164 attached to them at scores 166.

The corrugations in the corrugated paperboard from which the blank 120 is cut lie parallel to the scores 132 at which the side panels 130 are connected to the main panels.

Figure 14:
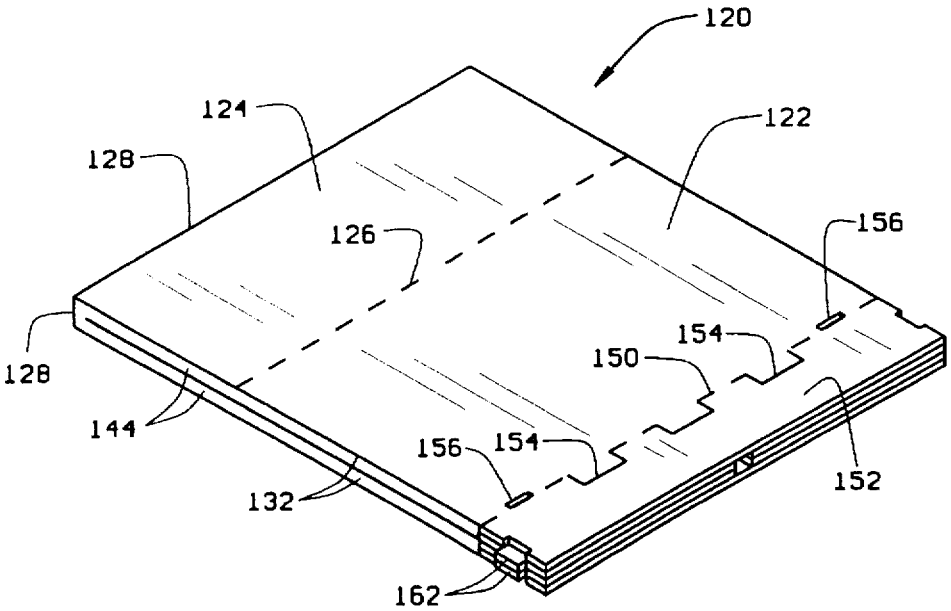
FIG. 14 is a perspective view of the blank of FIG. 13 folded into a flattened condition.

The box C is not sold in the form of the blank 120. Instead, the blank 120 is folded along its scores 144 and the liner panels 146 are brought over onto the bottom panel 124. Likewise the blank 120 is folded along the score 132, and the side panels 130 and top flaps 158 are brought over onto the main panels 122 and top flaps 152, respectively. The width of each main panel 122 is great enough to accommodate the side panels 130 from each of its two sides without any overlap of the side panels 130 or the extensions 134 on them. With the blank 120 so folded, it is again folded along the twin scores 128 in its bottom panel 124 so that the partially folded blank 120 is in effect doubled over onto itself (FIG. 14). However, the last fold is not made until glue is placed on the extensions 134 for the side panels 130 and the extensions 164 for the top flaps 158. Thus, when the blank 120 is doubled back upon itself, the extensions 134 and 164 that now lie inside the two main panels 122 come together and indeed are joined to create manufacturer's joints.

It is in this condition—that is with the attached side panels 130 lying face-to-face, and likewise against the main panels 122 and with the bottom panel 124 doubled back upon itself with the liner panels 146 captured within it (FIG. 14)—that the box C is stored and shipped to those who ultimately use it. In this knocked down condition the box C is in effect folded within its own perimeter and occupies very little space—indeed minimal space.

Figure 15:
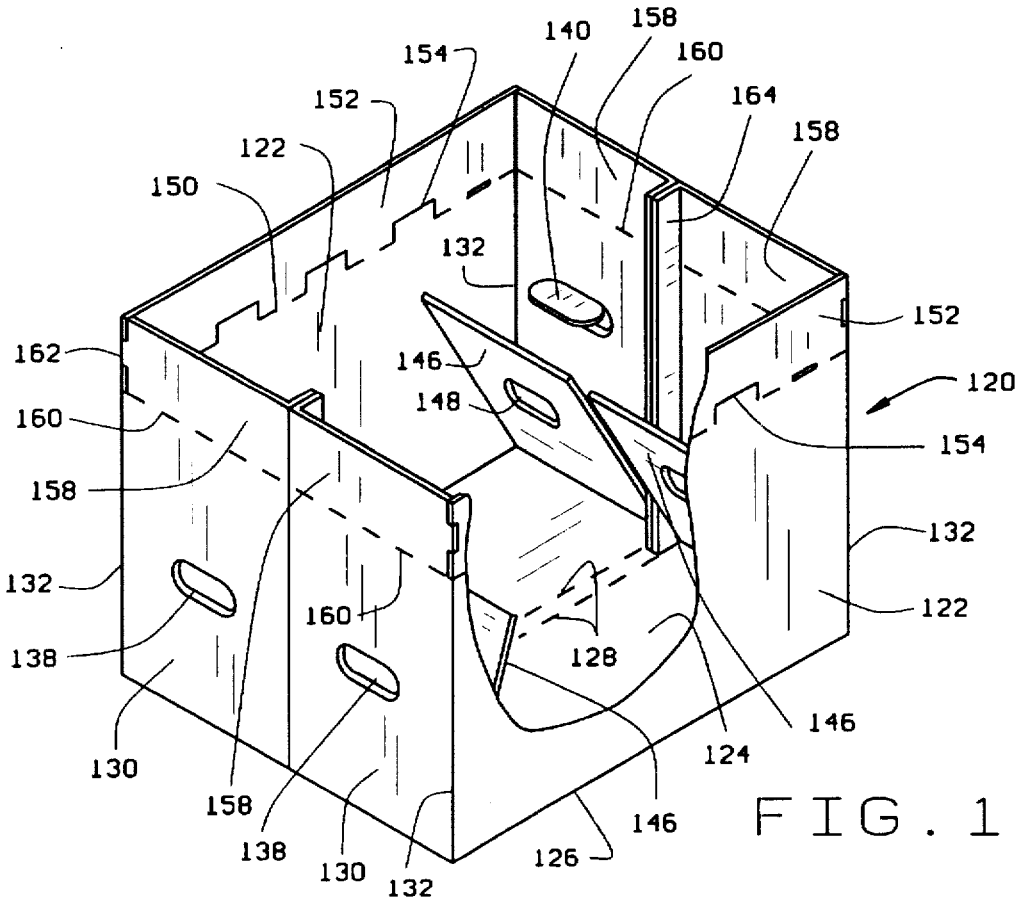
FIG. 15 is a perspective view of the folded blank of FIG. 14 being converted into the box of FIG. 11.

To erect the box C from its knocked-down condition, the user brings the main panels 122 to an upright position with the bottom panel 124 presented downwardly and indeed with the folded blank 120 resting on the small space between the twin scores 128 in the bottom panel 124. Simply by virtue of the weight of the folded blank 120, it tends to open and in this sense is self-erecting. The two halves of the bottom panel 124 fold away from each other and move the main panels 122 apart, and they fold relative to the bottom panel 124 along the scores 126. The connected side panels 130, being attached to the main panels 122 along the side scores 132, accommodate the separation of the panels 122 by swinging from their previous face-to-face condition generally into alignment. At this point the partially erected blank 120 assumes the general configuration of the box C (FIG. 15). But more is required.

The attached extensions 134, along which the side panels 130 of opposite main panels 122 are connected, project into the region enclosed by the upright main panels 122 and side panels 130 where they form the columns 112 of the erected box C. The attached extensions 164 for the flaps 152 at this juncture rise above the attached extensions 134, that is the columns 112.

Next the liner panels 146 are raised through the spaces between the main panels 122 and are brought against the inside faces of the side panels 130. The elongated cutouts 148 in the liner panels 146 generally register with the elongated cutouts 138 in the side panels 130, and the somewhat larger flaps 140 on the side panels 130 are forced out of the cutouts 138 and through the cutouts 148 in the liner panels 146, thereby locking the panels 130 and 146 together. This prevents the liner panels 146 from falling away from the side panels 130. The side panels 130 together with the liner panels 146 form the side walls 106 of the box C, whereas the main panels 122 form the front and back walls 102 and 104. The bottom panel 124 forms the bottom wall 108.

Next the top flaps 158 on the side panels 130 are folded toward each other with the joined-together extensions 164 on them deflected slightly so that they do not interfere with the joined-together extensions 134 at which the side panels 130 are joined. But the flaps 158 do not fold into the interior of the box C. Instead, where they are joined at their extensions 134, they come to rest on the upper ends of the extensions 134 for side panels 130, that is on the upper ends of the columns 112. Also, the lock tabs 162 at their ends align with and snap into the lock slots 156 in the scores 150 along the upper margins of the main panels 122. Thus, the flaps 158 assume a horizontal orientation along the side of the box C. The top flaps 152 along the main panels 122 fold downwardly onto the top flaps 158 of the side panel 130 and likewise assume a horizontal orientation. The folded flaps 152 and 158 form the supporting rim 114 on the box C. The tabs 116, which derive from the notches 154 in flaps 152, project from the main panels 122 above the rim 114.

This invention is intended to cover all changes and modifications of the example of the invention herein chosen for purposes of the disclosure which do not constitute departures from the spirit and scope of the invention.

What is claimed is:

1. A box comprising: an upright front wall; an upright back wall spaced from the front wall; a bottom wall connected to the front and back walls; upright side walls extended between and connected to the front and back walls, each side wall including a first side panel connected to the front wall and a second side panel connected to the back wall, each side panel of each side wall including an extension, the extensions for the side panels of each side wall being joined together to form a column which is located between the front and back walls and imparts enhanced strength to the side wall, the columns of the two side walls being spaced apart; and a separate beam attached to and supported by the columns between which it extends, the beam being spaced from the bottom wall.

2. A box according to claim 1 wherein the first side panel of each side wall is formed integral with the front wall and the second side panel of each side wall is formed integral with the back wall.

3. A box according to claim 1 wherein the columns rest on the bottom wall.

4. A box according to claim 1 wherein the bottom wall comprises a first bottom panel connected to the front wall, a second bottom panel connected to the back wall; and wherein more extensions project from each of the bottom panels and lie adjacent to each other to form a rib which projects toward the beam and extends between the two side walls.

5. A box comprising: a first wall; a second wall spaced from the first wall; a third wall extended between and connected to the first and second walls, the third wall having the capacity to fold relative to the first and second walls and also to fold along a fold line located intermediate the first and second walls such that when the first and second walls are moved together, the third wall will double back; side walls connected to and extended between the first and second walls, each side wall including a first side panel connected to the first wall such that the first side panel can fold relative to the first wall and a second side panel connected to the second wall such that the second side panel can fold relative to the second wall, the two side panels of each side wall further being connected to each other such that they can fold relative to each other, the side panels, by folding, permitting the first and second walls to move toward each other; and at least one liner panel connected to the third wall and lying against one of the side panels for one of the side walls, the liner panel being capable of folding relative to the third wall and against the third wall to enable the first and second walls to move toward each other without interference from the liner panel.

6. A box according to claim 5 wherein said one liner panel is one of several liner panels, there being in each side wall two liner panels attached to the third wall, there being a separate liner panel against each side panel; and wherein the liner panels of each side wall lie on opposite sides of the fold line along which the third wall has the capacity to fold.

7. A box according to claim 6 wherein each side panel and the liner panel that lies against that side panel have registered openings and one of the panels has a flap which extends from that panel through the opening in the other panel to hold the panels together.

8. A box according to claim 6 wherein each side wall has extensions projected from the side panels of the wall, and the extensions of the two side panels are joined together to form a column which projects into the interior of the box and extends to the third wall of the box at the fold line in the third wall; and wherein the side panels of each side wall fold relative to each other at the column.

9. A box according to claim 8 and further comprising flaps attached to the side walls and projecting over the the third wall, each flap having the capacity to fold relative to the side wall to which that flap is attached and also having the capacity to fold intermediate its ends in the region of the location at which the side wall to which the flap is connected folds.

10. A box according to claim 9 and further comprising additional flaps attached to the first and second walls and projecting from the first and second walls over the third wall.

11. A box comprising: an upright front wall; an upright back wall spaced from the front wall; a bottom wall connected to the front and back walls; upright side walls extended between and connected to the front and back walls, each side wall including a first side panel connected to the front wall and a second side panel connected to the back wall, each side panel of each side wall including an extension, the extensions for the side panels of each side wall being joined together to form a column which is located between the front and back walls and projects inwardly into the box where the column extends down to the bottom wall to impart enhanced strength to the side wall; and a beam attached to the columns above the bottom wall and extending through the box generally between the two side walls, the beam being of inverted U-shaped configuration, having spaced apart legs and a connecting segment between the legs, the legs of the beam lying along the sides of the columns and the connecting segment extending over the columns.

12. A box comprising: an upright front wall; an upright back wall spaced from the front wall; a bottom wall connected to the front and back walls, the bottom wall having at least on score which enables it to fold and double back; upright side walls extended between and connected to the front and back walls, each side wall including a first side panel connected to the front wall and a second side panel connected to the back wall, each side panel of each side wall including an extension, the extensions for the side panels of each side wall being joined together to form a column which is located between the front and back walls and projects into the box, the columns extending downwardly to the bottom wall and resting on the bottom wall along the score in the bottom wall to impart enhanced strength to the side walls, the first panels of the side walls having the capacity to fold where the first panels are connected to the front wall and the second panels of the side walls have the capacity to fold where the second panels are connected to the back wall, and the side panels of each side wall having the capacity to fold relative to each other, so that the front and back walls may be brought together to convert the box to a knocked-down condition.

13. A box according to claim 12 wherein the side panels in each side wall fold relative to each other at the columns.

14. A box according to claim 12 wherein the side walls further comprise liner panels connected to the bottom wall and lying against the side panels of the side walls, there being a separate liner panel for each side panel; and wherein the liner panels have the capacity to fold onto the bottom wall.

* * * * *